US005125561A

United States Patent [19]

Idstein

[11] Patent Number: 5,125,561

[45] Date of Patent: Jun. 30, 1992

[54] FOLIO INCLUDING FILING PERFORATIONS

[76] Inventor: Wilfried Idstein, Via Cavernago 10, CH-6911 Campione d'Italia, Switzerland

[21] Appl. No.: 694,202

[22] Filed: May 3, 1991

[30] Foreign Application Priority Data

May 3, 1990 [DE] Fed. Rep. of Germany ..... 4014222

[51] Int. Cl.[5] ..... B65D 27/00; B65D 27/04; B65D 27/08

[52] U.S. Cl. ..... 229/1.5 R; 229/71; 229/72; 40/359

[58] Field of Search ..... 229/1.5 R, 72, 71; 40/359, 404, 405; 281/31; 402/79

[56] References Cited

U.S. PATENT DOCUMENTS

| | | | |
|---|---|---|---|
| D. 275,576 | 9/1984 | Kirk | 402/79 X |
| 1,408,509 | 3/1922 | Housh | 229/1.5 R |
| 1,446,232 | 2/1923 | Wilburger | 229/1.5 R X |
| 1,464,378 | 8/1923 | Wilburger | 229/72 |
| 1,742,993 | 1/1930 | Jettinger | 40/359 |
| 1,807,467 | 5/1931 | Bonander | 40/405 X |
| 2,599,768 | 6/1952 | Losch | 40/359 X |
| 3,129,872 | 4/1964 | Lutwack | 229/72 |
| 3,528,602 | 9/1970 | Ritchie | 229/72 X |
| 3,847,195 | 11/1974 | Tyrseck | 229/72 X |

*Primary Examiner*—Stephen Marcus
*Assistant Examiner*—Jes F. Pascua
*Attorney, Agent, or Firm*—Larson and Taylor

[57] ABSTRACT

A folio or folder comprises at least one main body portion and at least one pocket rigidly connected, on two sides thereof, to the main body portion. Punched out from the flat material of the pockets or of the main body portion, by virtue of a U-shaped punched cut, is at least one filing tongue which can selectively be folded along a folding edge, and is thus capable of being folded outwardly. With the aid of filing perforations provided in the filing tongues, the folio may be filed within a folder. The filing tongues can also be folded so as to adjoin an adhesive tongue affixed against the inner side of the main body portion or against one or more pocket flaps. The folding edge is located in a joined area of the folio in spaced relationship to the adjacent lateral edge of the main body portion.

12 Claims, 3 Drawing Sheets

FOLIO INCLUDING FILING PERFORATIONS

FIELD OF THE INVENTION

The present invention is concerned with a folio, folder or case including filing perforations provided in respective filing tongues or tabs, and more especially with a presentation folio for the accommodation of sheets of paper of sizes up to a predetermined standard size.

BACKGROUND OF THE INVENTION

Folios of the type described above comprise at least one main body portion dimensioned to be slightly larger than the standard size, and at least one pocket of cardboard, plastic foil or another flat material rigidly connected, on at least two sides thereof, to the main body portion. A folio or case of this type is disclosed in German utility model 89 05 631, wherein pocket flaps are joined to the opposite narrow sides of the rectangular body through folding edges, i.e., fold lines at the adjoining edges. The pocket flaps are affixed at the lateral edges thereof to the longitudinal sides of the main body. Provided on the lateral edges of the pocket flaps to be secured to the main body, or of the main basic body (or of both), are filing tongues or tabs protruding outwardly from the lateral edges and having no folding edge. If these tongues are folded inwardly, they tend to gape or bridge open a folio in the collapsed condition. The filing tongues of such conventional folios or cases are admittedly useful because they permit, as opposed to other state-of-the-art folders or cases, filing operations within a folder. However, these filing tongues interfere with or detract from the imposing character of presentation folios or cases, and cause inconvenience during handling.

In respect of folios having two main bodies in adjoining relationship through back folding edges with no pockets, German utility model 74 20 788 and Austrian patent 280944 disclose cutting a filing tongue including filing perforations from a main body. This filing tongue is capable of being unfolded beyond the back, exposing a filing mechanism (if provided in the folio), and thereby spoiling the imposing character of the case. However, what is more aggravating is the disadvantage that the filing tongues at the ends of the folding edges easily break, thereby destroying the utility of the folio. The risk of breakage is particularly likely if, according to German utility model 74 20 788, the folding edge of the filing tongue is disposed at a distance from the back of the folio because, in such a case, the center of gravity of the folio is located laterally of the filing tongue. Folios of this type must therefore in practice be made of a tear-resistant plastic material and thus the cost is correspondingly high; nevertheless they are suitable for representative purposes to a limited extent only.

SUMMARY OF THE INVENTION

It is, therefore, an object of the present invention to provide a folio or case of the aforementioned type which, depending on the requirements, can be used with or without filing tongues, and which at the same time permits mechanical manufacture thereof and insures stability with respect to shape and tear-resistance because of the structure thereof.

The above-described problems, in accordance with the invention, are solved through the provision of filing tongues or tabs—disposed in the plane of the adjacent area of the flat material from which the tongues are cut—which are disposed between the lateral edges of the folio and, through folding along a folding edge or fold line disposed at a distance from the adjoining lateral edge of the main body, can be unfolded so as to extend beyond the side edge. Further, the area of the flat material adjoining the filing tongues, between the folding edge and the adjacent lateral edge, is affixed, e.g., by an adhesive, to another portion of the folio.

In the folio according to the invention, the arrangement of the filing tongues on a lateral edge formed (e.g., welded or cemented) into multiple layers ensures, on one hand, the desired stability regarding shape by providing a framing effect, and provides, on the other hand, high strength, and in particular, tear resistance in the area of the filing tongues, because the cemented or welded material layers combat the formation of cracks which normally occur at the ends of the folding edges of the filing tongues. The strength can be still further increased by doubling the material strength of the filing tongues through cementing or otherwise securing together of filing tongues cut from the material of the pockets, and filing tongues attached to an adhesive tongue on the main body.

The folio or case of the invention, in a variety of forms or embodiments, can be improved when taking into consideration the various fields of end use or application. In particular, it is possible to minimize the amount of material to be used by cutting the filing tongues from the material of the pocket disposed internally, with the folio being closed.

BRIEF DESCRIPTION OF THE DRAWINGS

Further forms or embodiment of the folio according to the invention will now be described in closer detail with reference to the drawings, wherein.

DESCRIPTION OF THE PREFERRED EMBODIMENTS

Figure 1A:
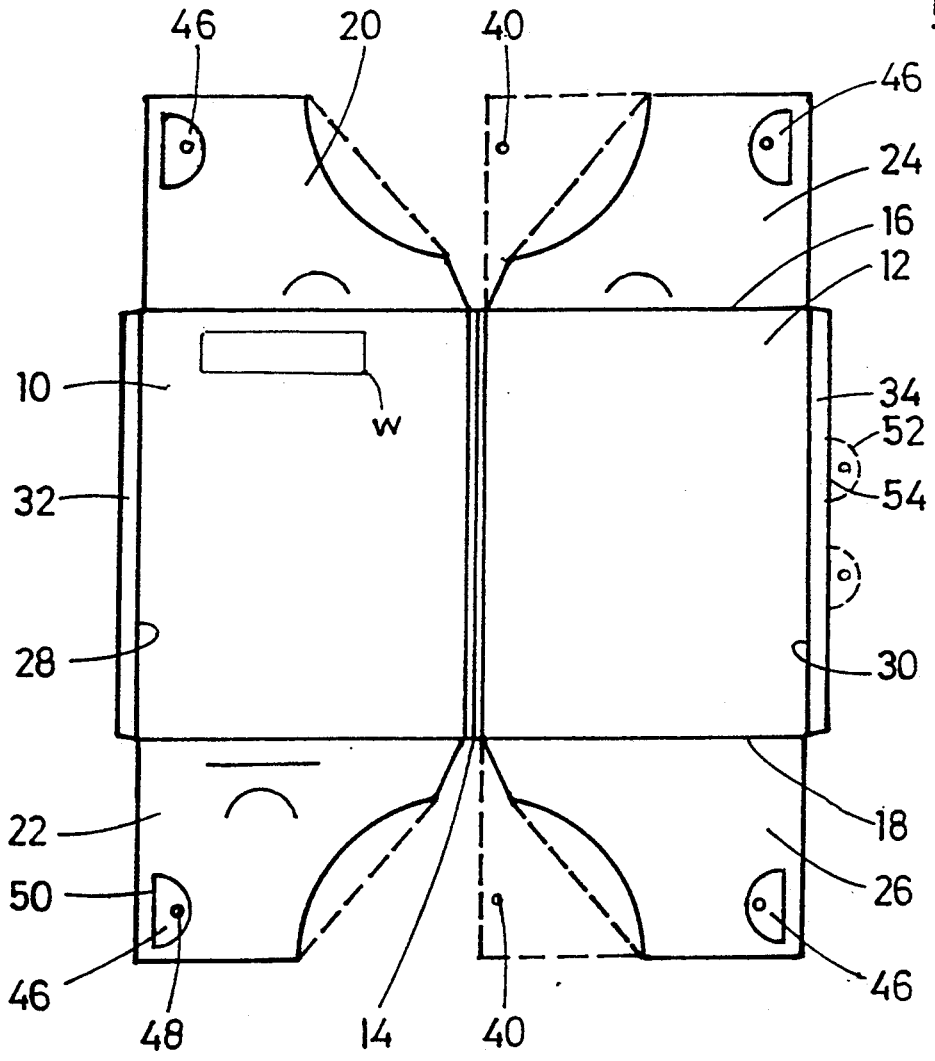
FIGS. 1A and 1B are plan views of a cardboard blank for manufacturing a presentation folio or case in accordance with a preferred embodiment of the invention, and of the ready-for-use folio in unfolded condition.
Figure 1B:
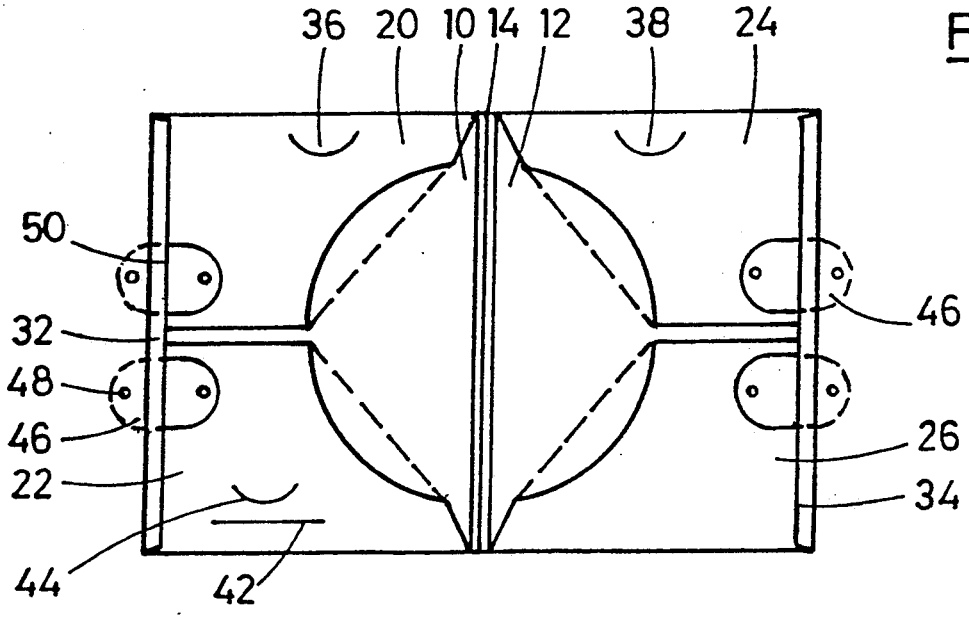

As is best shown in FIG. 1A, the final, ready-to-use presentation folio or case of FIG. 1B which, in the present example or embodiment, is intended to accommodate sheets of paper of DIN A 4 standard, is made of two equal-sized, rectangular main or basic bodies or body portions 10, 12 of a size slightly exceeding the DIN A 4 standard and, through a triple folding edge 14, along one of their longitudinal sides, are in adjoining relationship with one another and, at the narrow sides thereof, through folding edges 16, 18, are respectively in communication with pocket flaps 20, 22 and 24, 26, respectively. Moreover, adhesive tongues or strips 32 and 34, respectively, through folding edges 28 and 30, respectively, adjoin the outer longitudinal sides of the main bodies 10, 12. The folding edges 16, 18 and 28, 30 also may be dual or triple folding edges if the folio is intended to accommodate large amounts of material.

After punching of the blank shown in FIG. 1A, in the course of the mechanical manufacture of the folio according to FIG. 1B, the pocket flaps 20, 22 and 24, 26 are folded inwardly against the internal side of the main bodies 10, 12, whereafter, at the lateral external edges thereof, they are cemented or otherwise affixed to the adhesive tongues 32 and 34, which are respectively folded thereover. This will place the folio into a condition ready for use. In the collapsed condition thereof, the folio is of the rectangular shape of one of the main bodies 10, 12, having circumferential, straight-line, smooth lateral edges. In the unfolded condition according to FIG. 1B, the folio is capable of respectively accommodating in the interior thereof, within a lefthand pocket between the main body 10 and the pocket flaps 20, 22 and within a righthand pocket between the main body 12 and the pocket flaps 24, 26, a plurality of sheets of DIN A 4 standard. As the pocket flaps 20, 22 and 24, 26 respectively extend a distance only approximately midway of the longitudinal side of the main bodies 10, 12, there is the additional capability of placing further sheets of paper sized up to the DIN A 4 standard, between the basic body 10 and the lower pocket flap 22 in a manner such that the sheets lie above the upper pocket flap 20. The sheets are thus separated by the latter from the other sheets of paper placed into the lefthand pocket and are capable of being easily drawn out or removed. Equally, one or more sheets of paper, on the righthand side of the folio, may be placed between the main body 12 and the bottom pocket flap 26 only, so as to be located on the upper pocket flap 24. Hence, in a folio composed, in unfolded condition according to FIG. 1B, of two layers of flat material only, such as cardboard or plastic material, four separate compartments are provided for the papers or other material to be accommodated. An additional advantage resides in the fact that the upper half of the top or uppermost letter or brochure inserted (by means of only the bottom half) into the righthand or lefthand pocket of the folio, is immediately exposed when folding up the folio such that the address in the letter or the title of the brochure or, optionally, the lists of contents of the lefthand and righthand pockets, will be immediately apparent on first sight.

To also ensure the sheets of paper inserted only into the bottom half of the pocket are circumferentially held safely in the closed folio and, in particular, are prevented from slipping out from the folio upwardly, tongues 36, 38 are punched out through means of U-shaped punched cuts near the upper marginal edge of the upper pocket flaps 20, 24 cemented to the main bodies 10, 12. Tongues 36, 38 can be lifted and placed above the upper marginal edges of the sheets of paper which are inserted with the bottom halves thereof into the pockets of the folio. The relatively small-sized tongues 36, 38, do not substantially affect viewing of the sheets of paper with their upper halves exposed.

In a preferred practical form of embodiment, the pocket flaps 20, 22 and 24, 26, in the blank according to FIG. 1A, are respectively, at their free ends, substantially narrower than at the ends of the folded edges 16, 18 so that in the final condition of the folio according to FIG. 1B, a central opening is formed which permits viewing of part of the pocket contents, thereby facilitating the insertion of materials into the pockets The transitional area from the broader or longer side of the pocket flaps at the folded edges 16, 18 to the more narrow inner end may be cut or formed in a substantially straight-line manner as indicated in dashed lines in FIG. 1A and FIG. 1B. It will be understood that the transitional areas can also be of any other desired shape, e.g. of a curved configuration, so that, in the unfolded condition according to that shown in FIG. 1B, a generally circular opening is formed.

It will also be understood that the pocket flaps of the lefthand and righthand pockets need not necessarily be of identical configuration. As shown in dashed lines in FIG. 1A to the right thereof, the pocket flaps 24, 26 also may be of rectangular pattern; in addition, next to the lateral edge defining the inlet opening of the pocket, flaps 24, 26 may be provided with holes 40 which, in the final condition of the pocket, are capable of holding a filing mechanism for filing additional sheets of paper externally of the righthand pocket.

In order to provide, substantially without incurring any additional cost, the further function of accommodating a calling card in a manner in which the card is readily visible and is held securely, according to the example of the illustrated embodiment, the lefthand bottom pocket flap 22, next to the folding edge 18 thereof, in parallel thereto, has punched therein a straight-line slot or cut 42 approximately of the length of a calling card and, in the final condition of the folio according to FIG. 1B, has a U-shaped punch slot or cut thereabove so that a tongue 44 formed thereby can be placed above the upper marginal edge of a calling card with the bottom marginal edge of the card being inserted into the slot 42. In addition, a transparent window, indicated at W in FIG. 1A may be provided in a main portion 19, with the parts of main body 10 surrounding the window W acting as a frame for the window W.

Externally visible holes in the body of the folio or in filing tongues adjoining the same are likely to affect the outward aesthetic appearance thereof. Nevertheless, to provide the capability of filing the folio within a folder, according to the examples of embodiments of FIGS. 1A and 1B, by means of U-shaped punched cuts, filing tongues or tabs 46 are punched from pocket flaps 20, 22 and 24, 26. Each of these filing tongues 46 is provided with a filing perforation 48. Provided between the ends of each of the U-shaped punched outs, by means of an impression made into the flat material, is a folding edge or fold line 50. The folding edges 50 of all filing tongues 46 extend respectively in spaced parallel relationship to the longitudinal sides of the main bodies or blank sections 10 and 12, and, in the final condition of the folio shown in FIG. 1B, are located directly on or underneath the marginal edge of the corresponding adhesive tongues or flaps 32 and 34, respectively. The length of the filing tongues of tabs 46 is dimensioned so as to cause the filing perforations 48 therein to be disposed externally of the folio once the filing tongues 46, at the folding edges 50 thereof, are folded outwardly by 180°, into the position shown in dashed lines in FIG. 1B. The distance between the filing tongues 46 in the final condition of the folio according to FIG. 1B is so selected that the filing perforations 48 of the unfolded filing tongues 46 have the standard spacing therebetween of conventional filing devices and mechanisms.

In lieu of filing tongues 4 punched from the pocket flaps, it is also possible for filing tongues 52 to be provided which adjoin, through folding edges 54, the adhesive tongues 32 and 34, respectively, as shown in FIG. 1A to the right thereof. After the adhesive tongues 32 and 34 having been caused to adhere to the pocket flaps 20, 22 and 24, 26, the unadhered filing tongues 52 can, by means of their folding edge 54, be folded outwardly into the same position in which the filing tongues 46 are shown in broken lines in FIG. 1B. In addition, it is possible to combine and, optionally, to cement the filing tongues 52 with the filing tongues 46 punched from the pocket flaps. It will be appreciated that doubling the material strength of the resultant filing tongue formed by filing tongues 46 and 52 will result in enhanced strength and load-carrying capacity.

Figure 2:
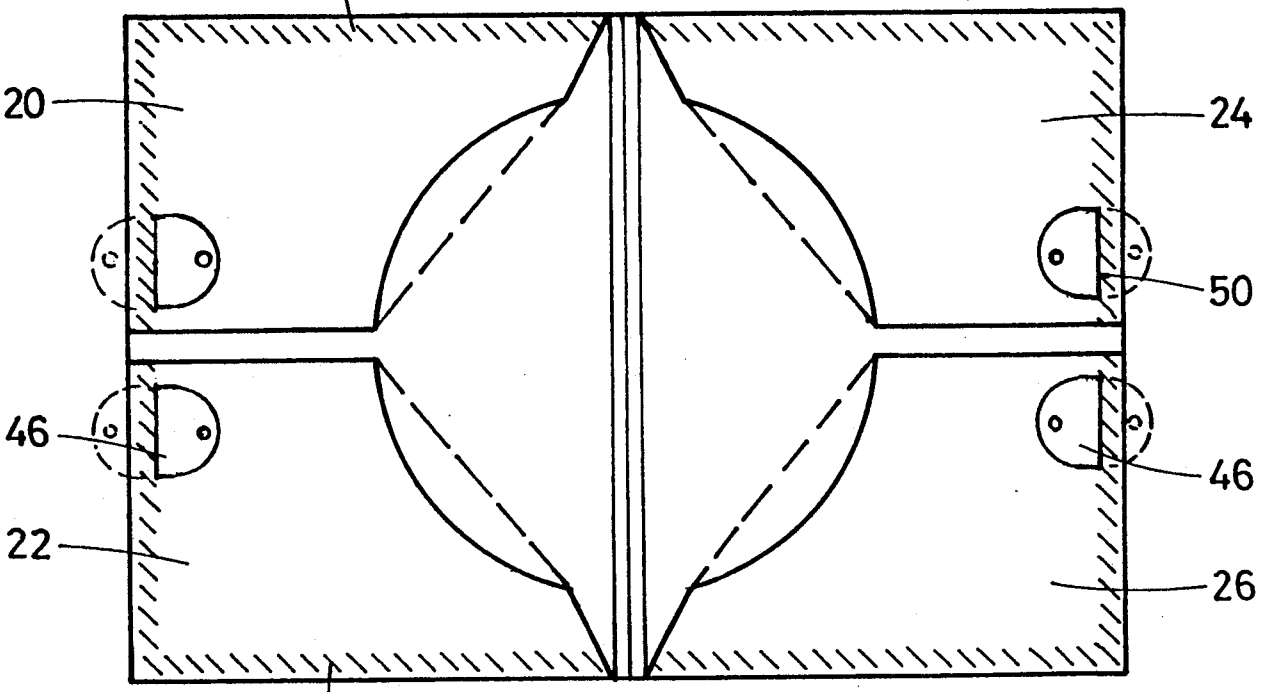
FIGS. 2 shows a view of another form of an embodiment corresponding to FIG. 1B.

As shown in FIG. 2, especially with folios made of plastic material, pocket flaps 24 and 26 can be individually cut and welded or cemented both to the narrow sides and to the longitudinal side of the main body portion or section 12. In that case, the folding edge 50 of the filing tongues 46 punched from the material of the pocket flaps 24 and 26 is located on the internal edge of the welded or cemented area.

In contrast to the specific embodiments described above, the principle of the invention is, of course, also applicable to folios having pockets of different configuration, e.g., to folios in which one pocket is formed only by a single pocket flap cemented or welded to a main or base body portion, irrespective of whether the blank of the pocket flap adjoins the main body through a folding edge or is individually punched and then welded or cemented on several sides to the main body, as shown in FIG. 2. Alternatively, it will also be possible for adhesive tongues to be provided both on the two opposing narrow sides of a main body and on the one longitudinal side thereof. As a result, with the aid of which adhesive tongues, for example, pocket flaps made of a different material can then be secured in place. In the event that no pocket at all is provided on the one side and the main or base body rather only forms a cover for the folio, there is likewise the possibility of providing filing tongues such that the same adjoin, through a folding edge 54, an adhesive tongue 34 to be cemented or otherwise affixed to the inner side of the cover, as shown in FIG. 1A to the right thereof.

As should be readily evident from FIGS. 1B and 2, it is also possible to provide, in addition to the filing tongues 46 and 52, respectively, one or more additional tongues or tabs which, through suitable connecting elements, will hold together the two halves of the folio, in closed condition, in a manner similar to a belt or buckle.

Figure 3A:
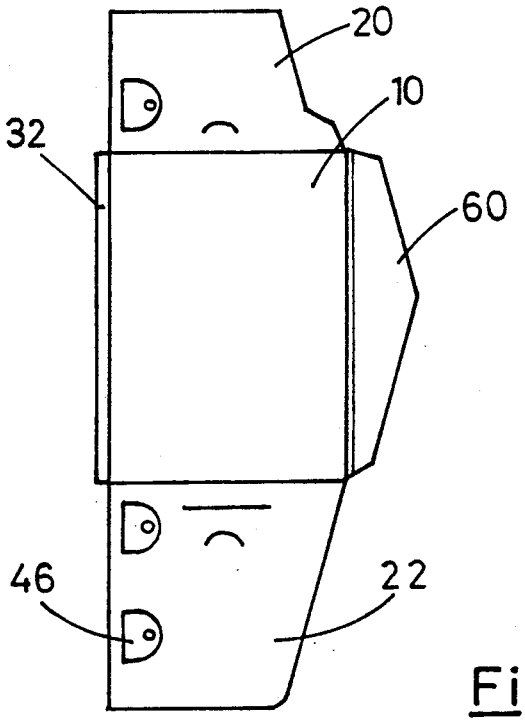
FIGS. 3A, 3B and 3C show another embodiment of the folio of the invention as a blank in mounted, opened and closed conditions, respectively.
Figure 3B:
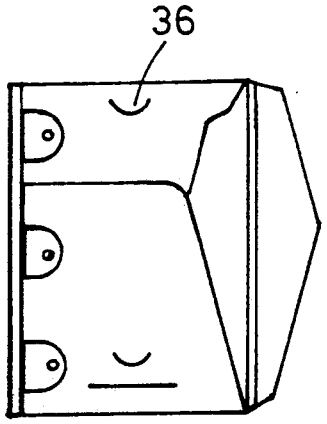
Figure 3C:
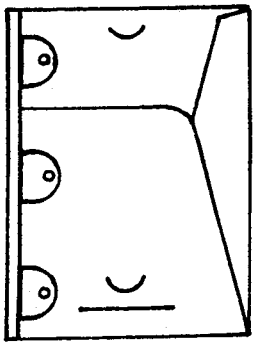

Referring to FIGS. 3A to 3C, FIG. 3A shows the blank for a folio having a single basic body or main blank section 10. In this case, the pocket flaps 20 and 22 are of different size so that, in the mounted or partially closed condition shown in FIG. 3B, the bottom pocket flap 22 (as viewed in FIG. 3A) partly covers the upper pocket flap 20. The pocket flaps 20 and 22 are affixed to the longitudinal side of the basic body 10 by an adhesive strip or flap 32, in a manner similar to the embodiment of FIG. 1A. Further, formation of filing tongues 46 in the pocket flaps 20 and 22, basically corresponds to the configuration shown in FIG. 1A with the exception that a total of three filing tongues 46 is provided and the filing perforations of these tongues are spaced apart corresponding to the applicable standard prescribed in the United States. Moreover, the pocket flaps of the embodiment according to FIGS. 3A to 3C also may be provided with punched cuts, of the type as shown in FIGS. 1, to form slots and tongues 36, 42, 44, respectively. The folio according to FIGS. 3A to 3C is closed by a relatively small closure flap 60 which is of a substantially triangular configuration and is bevelled at the outer edge such that to provide closing of the folio, a portion of flap 60 can be easily disposed underneath the bottom pocket flap 22 which, for that purpose, is equally bevelled on one of the side edges thereof, thereby, in the closed position, covering, in part, the upper pocket flap 20, as shown in FIG. 3C.

The folio according to FIGS. 3A to 3C permits, in addition to permanently and safely storing documents, a partly visible, external securing in place of the documents by insertion thereof only underneath the bottom pocket flap 22, i.e., such that the documents are disposed externally of the upper pocket flap 20 and, in that position, are not only fixed by the bottom pocket flap 22 but also by the closing flap 60 and the tongue 36 within the upper pocket flap 20.

What is claimed is:

1. A folio for the accommodation of sheets of paper of sizes up to a predetermined standard size, said folio comprising at least one main body portion of a size slightly larger than said standard size, at least one pocket of a flat material rigidly connected, on at least two sides thereof, to the main body portion, and a plurality of foldable filing tongues, cut out from the flat material, which are movable between a first position wherein the filing tongues are disposed in the plane of an adjoining area of the flat material from which the filing tongues are cut, and located between lateral edges of the folio, and a second position wherein, through pivoting thereof along a folding edge disposed in spaced relationship to the closest adjoining lateral edge of the main body portion, the filing tongues extend beyond the said adjoining lateral edge, the area of the flat material adjacent to the filing tongues between the folding edge and said adjoining lateral edge being secured to another part of the folio.

2. A folio according to claim 1, wherein the filing tongues are cut from the flat material of at least one pocket and wherein, between the folding edge thereof and the adjoining lateral edge of the main body portion, the flat material of the pocket is secured in place in the manner of a strip.

3. A folio according to claim 2, at least one pocket is formed by a pocket flap, along a folding edge of the pocket flap, adjoining a lateral edge of the main body portion, said pocket flap being adhesively affixed, along another edge of the main body portion, said folding edge of the filing tongues being disposed on a marginal edge of an adhesive tongue adjoining the main body portion and being folded over the pocket flap and adhesively secured thereto.

4. A folio according to claim 1, wherein a pocket flap adjoins at least one lateral edge of the main body portion, along a folding edge of the pocket flap, said pocket flap being affixed along another edge of the main body portion by a adjoining adhesive tongue, and wherein at least one filing tongue adjoins, along a folding edge, the adhesive tongue.

5. A folio according to claim 1, wherein one said pocket flap is connected to the main body portion at each of the two opposed lateral edges thereof so as to form two pockets, and wherein the two pockets at most partially overlap.

6. A folio according to claim 5, wherein the pockets are narrower in a central area of the main body portion than at a lateral edges thereof.

7. A folio according to claim 1, wherein two main body portions are connected together by at least two parallel fold lines.

8. A folio according to claim 1, wherein at least one pocket flap includes, in predetermined spaced relationship to an adjoining upper marginal edge of the main body portion, at least one substantially U-shaped punched out cut therein so as to form a tongue having a free end which extends away from said upper marginal edge.

9. A folio according to claim 1, wherein a said pocket flap includes, in predetermined spaced relationship to a lower marginal edge of the main body portion, a slot extending in parallel to said lower marginal edge of the main body portion and, spaced further from said lower marginal edge, a substantially U-shaped punched out cut therein forming a tongue having a free end which extends towards the slot.

10. A folio according to claim 5, wherein the pockets each include a performation for attaching to the folio a filing mechanism.

11. A folio according to claim 1, wherein at last one main body portion comprises a frame defining a transparent window.

12. A folio according to claim 1, further comprising a closure flap adjoining a longitudinal side of the main body portion connected to pocket flaps along a folding edge of the pocket flaps, said closure flap being, in use, placed partially beneath a pocket flap connected to a lower edge of the main body portion so as to partially cover a pocket flap connected to an upper edge of the main body portion.

* * * * *